US006517426B2

(12) United States Patent
Lee

(10) Patent No.: US 6,517,426 B2
(45) Date of Patent: Feb. 11, 2003

(54) COMPOSITE POLISHING PAD FOR CHEMICAL-MECHANICAL POLISHING

(75) Inventor: Gregory C. Lee, Belmont, CA (US)

(73) Assignee: Lam Research Corporation, Fremont, CA (US)

( * ) Notice: Subject to any disclaimer, the term of this patent is extended or adjusted under 35 U.S.C. 154(b) by 125 days.

(21) Appl. No.: 09/828,626

(22) Filed: Apr. 5, 2001

(65) Prior Publication Data

US 2002/0146973 A1 Oct. 10, 2002

(51) Int. Cl.[7] ..... B24D 11/00

(52) U.S. Cl. ..... 451/537; 451/526; 451/529; 451/533; 451/534; 451/538; 451/539

(58) Field of Search ..... 451/526, 529, 451/533, 534, 537, 538, 539

(56) References Cited

U.S. PATENT DOCUMENTS

| | | | | |
|---|---|---|---|---|
| 5,212,910 | A | | 5/1993 | Breivogel et al. |
| 5,230,184 | A | | 7/1993 | Bukhman |
| 5,533,923 | A | | 7/1996 | Shamouilian et al. |
| 5,534,106 | A | * | 7/1996 | Cote et al. ..... 156/636.1 |
| 5,584,146 | A | | 12/1996 | Shamouillan et al. |
| 5,607,341 | A | | 3/1997 | Leach |
| 5,609,517 | A | | 3/1997 | Lofaro |
| 5,702,290 | A | | 12/1997 | Leach |
| 5,836,807 | A | | 11/1998 | Leach |
| 5,899,745 | A | | 5/1999 | Kim et al. |
| 5,913,713 | A | | 6/1999 | Cheek et al. |
| 5,921,853 | A | | 7/1999 | Nishio |
| 5,944,583 | A | | 8/1999 | Cruz et al. |
| 6,062,968 | A | | 5/2000 | Sevilla et al. |
| 6,139,409 | A | | 10/2000 | Inaba |
| 6,168,508 | B1 | | 1/2001 | Nagahara et al. |

* cited by examiner

*Primary Examiner*—M. Rachuba
*Assistant Examiner*—Shantese McDonald
(74) *Attorney, Agent, or Firm*—Brinks Hofer Gilson & Lione

(57) ABSTRACT

A composite polishing pad for use in a linear chemical-mechanical polishing apparatus is provided. The pad comprises a hard polishing pad having a polishing surface and an attachment surface opposite the polishing surface, the attachment surface comprising a border comprising an adhesive, the border surrounding a cavity, the cavity being sized and shaped to receive a soft polishing pad. The soft polishing pad is disposed completely in the cavity and completely fills the cavity, and the soft polishing pad has a first side adhered in the cavity of the hard polishing pad, and a second side comprising an adhesive, whereby the attachment surface of the hard polishing pad and the second side of the soft polishing pad are substantially in a common plane. Other composite polishing pads are also provided, as are methods for making composite pads and methods for preventing composite pads from splitting apart into their component pads.

20 Claims, 1 Drawing Sheet

COMPOSITE POLISHING PAD FOR CHEMICAL-MECHANICAL POLISHING

FIELD OF THE INVENTION

The present invention relates to a composite polishing pad for use in an apparatus for the linear chemical mechanical planarization of surfaces such as semiconductor wafers.

BACKGROUND

Chemical mechanical planarization (CMP) is a process used to planarize raw semiconductor wafers and each layer of material added to the semiconductor wafer thereafter. Conventional CMP systems often use a rotating wafer holder that brings the semiconductor wafer into contact with a polishing pad. The polishing pad moves in the plane of the semiconductor wafer surface to be polished. A polishing fluid, such as a chemical polishing agent or slurry containing microabrasives, is applied to the polishing pad. The wafer holder then presses the semiconductor wafer against the rotating polishing pad, and polishing commences.

Commercially available polishing pads come in a variety of hardnesses. Softer polishing pads have certain advantages. Softer polishing pads can more easily conform to the different features on the wafer and tend to achieve global planarity. Also, they tend to scratch the surface of the semiconductor wafer less than hard pads. Soft polishing pads also provide a better vehicle than hard polishing pads for delivering slurry to the polishing site because the slurry can soak into the soft polishing pad material. Soft polishing pads do, however, have some disadvantages. Although they achieve better global planarity, it is done at the expense of local planarity. Also, soft polishing pads tend to polish away material more slowly, given the same speed and pressure as a hard polishing pad. Harder polishing pads, although they achieve better local planarity, achieve that result at the expense of global planarity.

Composite polishing pads have been created to attempt to combine the best features of soft and hard polishing pads. Two examples are "sandwich" types, which use vertical stacking of hard and soft layers (U.S. Pat. No. 5,212,910 to Breivogel, et al., hereby incorporated by reference), and "distributed" types which attach hard pieces to a soft support layer (U.S. Pat. No. 5,230,184 to Bukhman, hereby incorporated by reference).

These types of composite polishing pads tend to degrade easily over time as the polishing pads wear. The soft material tends to lose its elasticity, and the composite pad becomes loaded with polish residuals and slurry, Further, in the sandwich polishing pads, the hard polishing pad layer tends to split apart from the soft polishing pad layer as a result of wear and tear. Thus, the polishing pad life is shortened.

Accordingly, there remains a need for a composite polishing pad that provides uniform planarity, extended pad life, and good slurry delivery.

SUMMARY

The composite polishing pads and the methods disclosed herein solve at least some of the problems left unsolved by conventional polishing pads.

In one aspect of the invention, a composite polishing pad for use in a linear chemical-mechanical polishing apparatus is provided. The pad has a hard polishing pad having a polishing surface and an attachment surface opposite the polishing surface. The attachment surface has a border comprising an adhesive, and the border surrounds a cavity. The cavity is sized and shaped to receive a soft polishing pad. The soft polishing pad is disposed completely in the cavity and completely filling the cavity. The soft polishing pad has a first side adhered in the cavity of the hard polishing pad, and a second side comprising an adhesive, such that the attachment surface of the hard polishing pad and the second side of the soft polishing pad are substantially in a common plane.

In another aspect of the invention, a composite polishing pad includes a hard polishing pad having a polishing surface and an attachment surface opposite the polishing surface, the attachment surface comprising a border comprising an adhesive, the border surrounding a cavity. The cavity is adapted to receive a soft polishing pad; the soft polishing pad disposed completely in the cavity and completely filling the cavity. The soft polishing pad has a first side adhered in the cavity of the hard polishing pad and a second side comprising an adhesive, whereby the attachment surface of the hard polishing pad and the second side of the soft polishing pad are substantially in a common plane. The composite polishing pad is adhered to a belt in the linear chemical-mechanical polishing apparatus.

In still another aspect of the invention, a composite polishing pad includes a hard polishing pad of a certain length having a polishing surface and an attachment surface opposite the polishing surface, the attachment surface comprising an adhesive; a soft polishing pad of a length less than the length of the hard polishing pad, the soft polishing pad having a first side adhered to a first portion of the attachment surface of the hard polishing pad, and the soft polishing pad having a second side comprising an adhesive; and a steel belt in the linear chemical-mechanical polishing apparatus adhered to the second side of the soft polishing pad and to a second portion the attachment surface of the hard polishing pad.

In still another aspect of the invention, a method of making a composite polishing pad is provided. The method comprises (a) providing a hard polishing pad having a polishing side and an attachment side opposite the polishing side, the attachment side comprising an adhesive; (b) shaping the attachment side to form a border surrounding a cavity that is adapted to receive a soft polishing pad therein; (c) inserting the soft polishing pad into the cavity, the soft polishing pad being completely within the cavity and filling the cavity; and (d) adhering the soft polishing pad in the cavity.

In still another aspect of the invention, another method if making a composite polishing pad comprises: (a) providing a hard polishing pad of a predetermined length having a polishing side and having an attachment side opposite the polishing side, the attachment side comprising an adhesive; (b) providing a soft polishing pad of a length shorter than the length of the hard polishing pad, the soft polishing pad having a first side comprising an adhesive and a second side comprising an adhesive; (c) providing a belt in a linear apparatus for chemical-mechanical polishing; (d) adhering the second side of the soft polishing pad to the belt; (e) adhering a first portion of the attachment side of the hard polishing pad to the soft polishing pad; and (e adhering a second portion of the attachment side of the hard polishing pad to the belt.

In yet another aspect of the invention, a method of preventing a composite polishing pad from splitting apart is provided. The method comprises: (a) providing a hard polishing pad having a polishing side and an attachment side opposite the polishing side, the attachment side comprising an adhesive; (b) shaping the attachment side to form a border surrounding a cavity that is adapted to receive a soft polishing pad therein; (c) inserting the soft polishing pad into the cavity, the soft polishing pad being completely within the cavity and filling the cavity; (d) adhering the soft polishing pad in the cavity to form a composite pad; and (e) adhering the composite pad to a belt in a linear chemical-mechanical polishing apparatus such that the border adheres to the belt and the soft polishing pad adheres to the belt.

The present invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PREFERRED EMBODIMENTS DEFINITIONS

"Hard polishing pad," as used herein, means a polishing pad having a hardness of about 40 durometers or greater on a Shore D scale. Preferably the hardness is from about 40 durometers to about 70 durometers, more preferably from about 50 durometers to about 60 durometers. Many materials may be used to manufacture a hard polishing pad, but preferably, a hard polishing pad comprises a rigid, microporous polyurethane material. Although many different hard polishing pads can be used with the present invention, particularly preferred hard polishing pads are the RODEL IC1000 pad or the FREUDENBERG FX9 hard pad, which are commercially available from RODEL in Newark, Del. and from FREUDENBERG in Lowell, Mass., respectively.

"Soft polishing pad," as used herein, means a polishing pad having a hardness of less than about 40 durometers on a Shore D scale. A soft polishing may comprise any suitable soft material, but it preferably comprises a polyurethane impregnated polyester felt pad such as SUBA. Although many different soft polishing pads can be used with the present invention, a particularly preferred soft polishing pad is the THOMAS WEST TW817 pad, which is commercially available from THOMAS WEST, in Sunnyvale, Calif.

FIGURES ILLUSTRATING PREFERRED EMBODIMENTS

Figure 1:
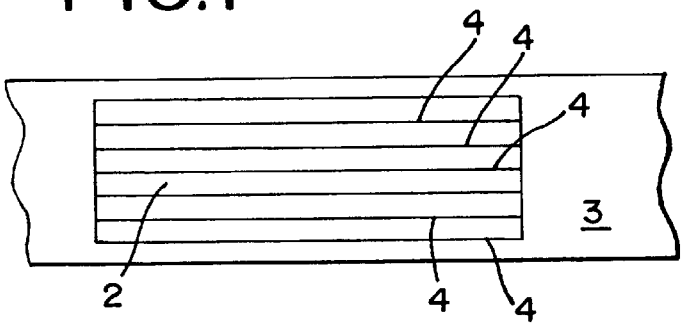
FIG. 1 is a top view of a preferred composite polishing pad.

Referring to FIG. 1, a top view of a preferred composite polishing pad 2 is shown. The composite polishing pad 2 is for use in a linear chemical-mechanical polishing (CMP) apparatus, for the polishing of semiconductor wafers, silicon-on-insulator surfaces, silicon-on-sapphire surfaces, and the like. Although the composite polishing pad 2 is intended for use with any suitable linear CMP apparatus, the TERES CMP system, available from LAM RESEARCH CORPORATION of Fremont, Calif. is preferred. A single composite polishing pad 2 is shown on a stiff support surface 3, preferably a linear belt 3, for use in a CMP apparatus.

Referring to FIG. 1, only the polishing surface of the composite polishing pad 2 is shown. Preferably, the polishing surface has longitudinal grooves 4 or slanted grooves 4, though grooves 4 are not necessary. The polishing surface may also be perforated, though perforations are not necessary. The polishing surface in the composite polishing pad 2 comprises a hard polishing pad, as defined above.

Figure 2:
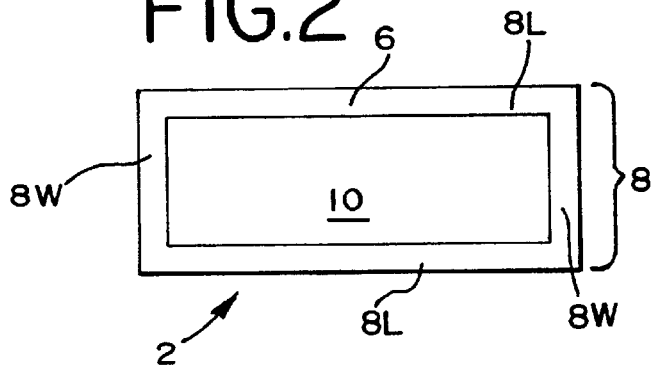
FIG. 2 is a bottom view of the composite polishing pad of FIG. 1.

Referring to FIG. 2, a bottom view of the composite polishing pad 2 is shown with the continuous linear belt 3 stripped away. A hard polishing pad 6 forms a border 8 around the soft polishing pad 10. In FIG. 2, the border 8 is generally rectangular, but it can be shaped like a parallelogram, or other geometric shapes. The border 8 has two longitudinal edges 8L and two ends 8W.

The width of border edges 8L is preferably constant. A width for border edges 8L should be chosen so that the hardness of the portion of the composite polishing pad 2 that contacts the surface to be polished is uniform. For example, assume a semiconductor wafer to be polished has a diameter of four inches and the linear belt 3 is six inches wide. Then, the width of each border edge 8L should be no greater than one inch. This way, the composite polishing pad 2 has a uniform hardness in the area that polishes the wafer—the four inches between the border edges 8L.

Optimal widths for 8L vary according to the width of the surface to be polished and the width of the continuous linear belt 3 in a particular CMP apparatus. In a standard TERES CMP apparatus, it is preferable that the border 8L be about 1 inch wide, though many other widths may be acceptable, such as 1.5 inches and 0.5 inches.

Similarly, the width of the border ends 8W are preferably constant. The width of border ends 8W is preferably small, to minimize any non-uniformities that might result from the composite polishing pad 2 being harder along its border ends 8W (which comprise only hard polishing pad 6) than in its central area (which comprises a hard polishing pad 6 and a soft polishing pad 10). Preferably, the border ends 8W are about one inch wide, more preferably about one-half inch wide.

To minimize inconsistencies that might result due to the composite polishing pad 2 being harder along its border ends 8W than in its central area, it is preferable to minimize the number of composite polishing pads 2 that are adhered to a given linear belt 3. This is done by adjusting the length of the composite polishing pads 2.

The length of the composite polishing pad 2 can equal to or less than the length of the continuous linear belt 3. If multiple composite polishing pads 2 are used on the single continuous linear belt 3, it is preferred that each of the multiple composite polishing pads 2 be equal in length.

Figure 5:
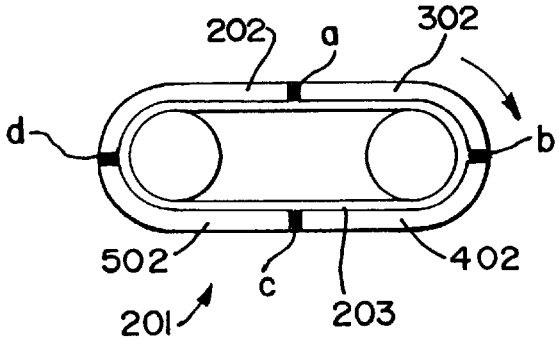
FIG. 5 is a linear CMP apparatus comprising a plurality of composite polishing pads aligned along a continuous linear belt.

For example, referring to FIG. 5, composite polishing pads 202, 302, 402, and 502 are equal in length and are aligned in a head-to-toe arrangement around the continuous linear belt 203 in the linear CMP apparatus 201. The central, longitudinal region extending through all four pads (the region of the pads that contacts the surface to be polished) has generally the same hardness throughout, except in areas A, B, C, and D. Areas A, B, C, and D represent the areas where the individual pads meet. Thus, each of areas A, B, C, and D is twice the width of border end 8W, and comprises only hard polishing pad. Accordingly, the areas A, B, C, and D diverge from the preferred uniform hardness of the single composite pad.

Because of the size and shape of commercially available hard polishing pads and commercially available soft polishing pads, it is presently preferred to align four, equally sized composite pads around a linear belt as shown in FIG. 5. Smaller composite polishing pads have the advantage of being easier to align evenly along the linear belt 203.

However, for improved uniformity, it may be advantageous to use only three composite polishing pads, two composite polishing pads, or even a single composite polishing pad around a continuous linear belt 203 to minimize any non-uniformities that might result from the individual composite polishing pads being harder along their border ends than in their central regions.

Referring again to FIG. 2, the width of the composite polishing pad 2 can be no longer than the width of the linear belt 3. The width of the composite polishing pad 2 can be no shorter than the diameter of the surface to be polished. Within those limits, the composite polishing pad can be any length. Preferably, the width of the composite polishing pad 2 is less than the width of the linear belt 3 by about 2 inches or by about 1 inch. The composite polishing pad 2 can be centered in the linear belt 3.

Figure 3:
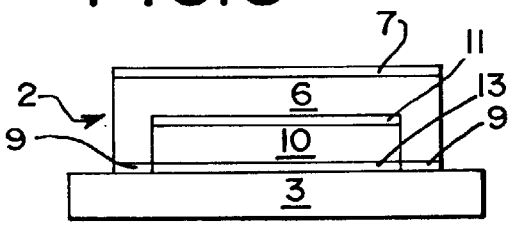
FIG. 3 is a cut-away end view of the composite polishing pad of FIG. 1.

Referring to FIG. 3, a cut-away end view of the composite polishing pad 2 adhered to the linear belt 3 is shown. The hard polishing pad 6 has a polishing surface 7 and another surface 9 opposite the polishing surface 7. The polishing surface 7 is preferably as described above for FIG. 1.

The surface 9 comprises an adhesive so that a portion of the hard polishing pad 6 adheres directly to the linear belt 3. The adhesive can be any adhesive known in the art. Preferably, the adhesive is the standard adhesive that comes with the RODEL IC1000 CMP pads.

The surface 9 that is opposite the polishing surface 7 has preferably been shaped during manufacture to have a cavity therein or cut or milled after manufacture to have a cavity therein. The cavity should be shaped and sized so that the soft polishing pad 10 fits entirely within the cavity and fills the cavity. Specialized milling, machining, and manufacturing vendors to make the cavity in the surface 9 of the hard polishing pad 6 to precise specifications are commercially available through the companies that provide and manipulate polishing pads, such as RODEL and THOMAS WEST.

The cavity is surrounded by the border 8, which has the dimensions 8L and 8W as described above. The depth of the cavity depends upon the particular soft polishing pad 10 being used. The depth of the cavity should equal the thickness of the soft polishing pad 10, including adhesive layer 11. Adhesive layer 11 can be part of the hard polishing pad 6, part of the soft polishing pad 10, or a separately packaged adhesive that can be applied to either or both the hard polishing pad 6 or the soft polishing pad 10. Preferably the adhesive layer 11 is the standard adhesive supplied with the soft polishing pad 10, such as the adhesive provided with the THOMAS WEST TW817 polishing pads.

An adhesive layer 13 should be in substantially the same plane as the adhesive on surface 9 so that both the adhesive layer 13 and the adhesive on surface 9 may adhere to the linear belt 3. The adhesive in adhesive layer 13 can be any adhesive known in the art. Preferably, the adhesive is the standard adhesive that comes with the THOMAS WEST TW817 polishing pads.

Advantageously, each of the component pads of the composite polishing pad 2 is independently adhered to the linear belt 3. The soft polishing pad 10 is preferably fully encapsulated between the hard polishing pad 6 and the linear belt 3, so that the seam between the hard polishing pad 6 and the soft polishing pad 10 is not exposed. Because the seam is not exposed and because the soft polishing pad 10 and the hard polishing pad 6 are independently adhered to the linear belt 3, the composite pad 2 is less likely to split apart prematurely.

The composite polishing pad 2 can be manufactured any number of ways. Assuming the hard polishing pad 6 has been provided with a cavity as described above, the soft polishing pad 10 (which is commercially available with adhesive layers 11 and 13) can be inserted into the cavity and adhered to the hard polishing pad 6 to form the composite polishing pad 2. Optionally, adhesive can manually be added between the soft polishing pad 10 and the hard polishing pad 6. Then when the composite polishing pad 2 is formed, it can be aligned on and adhered to a linear belt 3 with the adhesives that came with the commercially available hard polishing pads and soft polishing pads. Optionally, adhesive can be manually added between the composite polishing pad 2 and the linear belt 3.

Alternatively, the soft polishing pad 10 can be aligned to the linear belt 3 and adhered to the linear belt 3 as a first step. The next step would call for fitting the cavity of the hard polishing pad 6 over the soft polishing pad 10, and adhering the hard polishing pad 6 to the soft polishing pad 10 and the linear belt 3 at roughly the same time. A heated environment may optionally be used during any of the adhesion steps, according to procedures that are well known in the art.

Figure 4:
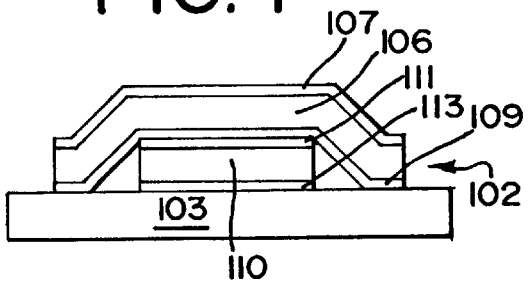
FIG. 4 is a cut-away end view of a second preferred embodiment of a composite polishing pad.

Referring to FIG. 4, another preferred composite polishing pad 102 is shown. In this embodiment, a hard polishing pad 106 has a polishing surface 107 and a second surface 109 opposite the polishing surface 107. The second surface 109 comprises an adhesive that adheres to the linear belt 103 and to an adhesive layer 111 of a soft polishing pad 110. The soft polishing pad 110 has a second adhesive layer 113 that adheres directly to the linear belt 103.

In this embodiment, the second surface 109 does not comprise a cavity into which the polishing pad 110 can be inserted. Instead, the hard polishing pad 106 lies upon the soft polishing pad 110, completely encapsulating the soft polishing pad 110 between the hard polishing pad 106 and the linear belt 103. For complete encapsulation, the hard polishing pad 106 must be longer and wider than the soft polishing pad 110. Then, the seam between the soft polishing pad 110 between the hard polishing pad 106 is not exposed, and both pads are independently adhered to the linear belt 103, making it more difficult for the composite polishing pad 102 to split apart prematurely.

This embodiment has the advantage of being less expensive to manufacture because it is not necessary to cut, machine, mill, or otherwise manipulate the hard polishing pad 106 to include a cavity therein. FIG. 4 shows, however, that composite polishing pad 102 does not have a constant flat polishing surface 107. Since uniform flatness is desirable in a polishing pad, it is preferable to minimize the number of composite polishing pads 102 that fit around a given linear belt. Because of the length of commercially available pads makes it convenient, presently four equally long composite polishing pads 102 can be fitted around a linear belt. It may be desirable to cover a linear belt with only one, two, or three composite polishing pads 102.

The composite polishing pad 102 can be manufactured any number of ways. The soft polishing pad 110 can be adhered to adhesive side of the hard polishing pad 106 before the entire composite polishing pad 102 is adhered to the linear belt 103. The adhesion can comprise adhesives that come with the commercially available pads, and they can also be enhanced the through the manual application of additional adhesive.

Alternatively, the soft polishing pad 110 can be aligned to the linear belt 103 and adhered to the linear belt 103 as a first step. The second step would call for laying the hard polishing pad 106 over the soft polishing pad 110, and adhering the hard polishing pad 106 to the soft polishing pad 110 and the linear belt 103 at roughly the same time. A heated environment may optionally be used during any of the adhesion steps, according to well-known procedures.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is therefore indicated by the appended claims rather than by the foregoing description. All changes that come within the meaning and range of equivalency of the claims are embraced to be within their scope.

What is claimed is:

1. A composite polishing pad for use in a linear chemical-mechanical polishing apparatus, the composite polishing pad comprising:

(a) a hard polishing pad having a polishing surface and an attachment surface opposite the polishing surface, the attachment surface comprising a border comprising an adhesive, the border surrounding a cavity, the cavity being sized and shaped to receive a soft polishing pad; and (b) the soft polishing pad disposed completely in the cavity and completely filling the cavity, the soft polishing pad having a first side adhered in the cavity of the hard polishing pad, and a second side comprising an adhesive, whereby the attachment surface of the hard polishing pad and the second side of the soft polishing pad are substantially in a common plane.

2. The composite polishing pad of claim 1 wherein the hard polishing pad has a hardness of from about 40 to about 70 durometers on a Shore D scale.

3. The composite polishing pad of claim 1 wherein the hard polishing pad has a hardness of from about 50 to about 60 durometers on a Shore D scale.

4. The composite polishing pad of claim 1 wherein the border of the hard polishing pad has a constant thickness of from about 1 mm to about 50 mm surrounding the cavity.

5. The composite polishing pad of claim 1 wherein the border of the hard polishing pad has a constant depth of from about 1000 micrometers to about 1500 micrometers.

6. The composite polishing pad of claim 1 wherein the polishing surface of the hard polishing pad includes longitudinal grooves.

7. The composite polishing pad of claim 1 wherein the hard polishing pad is a rigid, microporous polyurethane material that has been sized and shaped to define the cavity surrounded by the border.

8. The composite polishing pad of claim 1 wherein the soft polishing pad has a hardness of less than about 40 durometers on a Shore D scale.

9. The composite polishing pad of claim 1 wherein the soft polishing pad comprises a polyurethane-impregnated polyester felt pad.

10. A composite polishing pad for use in a linear chemical-mechanical polishing apparatus, the pad comprising:

(a) a hard polishing pad having a polishing surface and an attachment surface opposite the polishing surface, the attachment surface comprising a border comprising an adhesive, the border surrounding a cavity, the cavity being sized and shaped to receive a soft polishing pad;

(b) the soft polishing pad disposed completely in the cavity and completely filling the cavity, the soft polishing pad having a first side adhered in the cavity of the hard polishing pad, and a second side comprising an adhesive, whereby the attachment surface of the hard polishing pad and the second side of the soft polishing pad are substantially in a common plane; and (c) a rigid belt in the linear chemical-mechanical polishing apparatus adhered to the second side of the soft polishing pad and to the border of the attachment surface of the hard polishing pad.

11. A composite polishing pad for use in a linear chemical-mechanical polishing apparatus, the composite polishing pad comprising:

(a) a hard polishing pad of a length having a polishing surface and an attachment surface opposite the polishing surface, the attachment surface comprising an adhesive;

(b) a soft polishing pad of a length less than the length of the hard polishing pad, the soft polishing pad having a first side adhered to a first portion of the attachment surface of the hard polishing pad, and the soft polishing pad having a second side comprising an adhesive; and (c) a steel belt in the linear chemical-mechanical polishing apparatus adhered to the second side of the soft polishing pad and to a second portion the attachment surface of the hard polishing pad.

12. A method of making a composite polishing pad, comprising:

(a) providing a hard polishing pad having a polishing side and an attachment side opposite the polishing side, the attachment side comprising an adhesive;

(b) shaping the attachment side to form a border surrounding a cavity that is adapted to receive a soft polishing pad therein;

(c) inserting the soft polishing pad into the cavity, the soft polishing pad being completely within the cavity and filling the cavity; and (d) adhering the soft polishing pad in the cavity.

13. The method of claim 12 wherein the shaping step includes cutting the hard polishing pad.

14. The method of claim 12 wherein step (c) is carried out simultaneously with step (d).

15. The method of claim 12 wherein step (d) is carried out in a heated environment.

16. A method of making a composite polishing pad, comprising:

(a) providing a hard polishing pad of a predetermined length having a polishing side and having an attachment side opposite the polishing side, the attachment side comprising an adhesive;

(b) providing a soft polishing pad of a length shorter than the length of the hard polishing pad, the soft polishing pad having a first side comprising an adhesive and a second side comprising an adhesive;

(c) providing a belt in a linear apparatus for chemical-mechanical polishing;

(d) adhering the second side of the soft polishing pad to the belt;

(e) adhering a first portion of the attachment side of the hard polishing pad to the soft polishing pad; and (f) adhering a second portion of the attachment side of the hard polishing pad to the belt.

17. The method of claim 16 where step (d) is carried out before step (e).

18. The method of claim 16 where step (e) is carried out before step (d).

19. The method of claim 16 where step (d) and step (f) are carried out simultaneously.

20. A method of preventing a composite polishing pad from splitting apart into its component pads, comprising:

(a) providing a hard polishing pad having a polishing side and an attachment side opposite the polishing side, the attachment side comprising an adhesive;

(b) shaping the attachment side to form a border surrounding a cavity that is adapted to receive a soft polishing pad therein;

(c) inserting the soft polishing pad into the cavity, the soft polishing pad being completely within the cavity and filling the cavity;

(d) adhering the soft polishing pad in the cavity to form a composite pad; and (e) adhering the composite pad to a belt in a linear chemical-mechanical polishing apparatus such that the border adheres to the belt and the soft polishing pad adheres to the belt.

* * * * *